US006201525B1

(12) United States Patent
Janney

(10) Patent No.: US 6,201,525 B1
(45) Date of Patent: Mar. 13, 2001

(54) WEARABLE MOVING DISPLAY

(76) Inventor: Christopher Janney, 75 Kendall Rd., Lexington, MA (US) 02173

( * ) Notice: Subject to any disclaimer, the term of this patent is extended or adjusted under 35 U.S.C. 154(b) by 0 days.

(21) Appl. No.: 08/212,292

(22) Filed: Mar. 10, 1994

Related U.S. Application Data

(63) Continuation of application No. 08/023,140, filed on Feb. 24, 1993, now abandoned, which is a continuation of application No. 07/939,845, filed on Sep. 2, 1992, now abandoned, which is a continuation of application No. 07/636,312, filed on Dec. 31, 1990, now abandoned.

(51) Int. Cl.[7] ..... G09G 5/34
(52) U.S. Cl. ..... 345/124; 345/123
(58) Field of Search ..... 455/343, 347, 455/348, 349, 351; 368/10, 41–44; 341/21, 35; 63/2, 1.1, 20; 40/452; 345/82, 83, 44, 46, 123, 124, 33

(56) References Cited

U.S. PATENT DOCUMENTS

| | | | | |
|---|---|---|---|---|
| 2,616,215 | * | 11/1952 | Martial et al. | 63/20 X |
| 2,798,148 | * | 7/1957 | DiLizio et al. | 60/1.1 X |
| 3,521,049 | * | 7/1970 | Young | 63/1.1 X |
| 3,570,158 | * | 3/1971 | Hackett | 40/452 |
| 3,976,995 | * | 8/1976 | Sebestyen | 340/825.44 X |
| 4,009,381 | * | 2/1977 | Schreiber et al. | 63/2 X |
| 4,024,531 | | 5/1977 | Ashby | 340/334 |
| 4,107,782 | | 8/1978 | Cochran | 364/706 |
| 4,125,830 | | 11/1978 | Cochran et al. | 340/336 |
| 4,203,595 | * | 5/1980 | Thompson | 455/351 X |
| 4,296,459 | * | 10/1981 | DeLuca | 63/2 X |
| 4,307,391 | | 12/1981 | Lewis | 340/709 |
| 4,345,308 | | 8/1982 | Mouyard et al. | 362/332 |
| 4,385,291 | * | 5/1983 | Pignet | 368/41 |
| 4,539,700 | * | 9/1985 | Sato | 455/343 X |
| 4,602,191 | | 7/1986 | Davila | 315/76 |
| 4,682,162 | | 7/1987 | Holloman | 340/799 |
| 4,689,604 | | 8/1987 | Sokol | 340/755 |
| 4,738,042 | | 4/1988 | Corden et al. | 40/472 |
| 4,806,924 | | 2/1989 | Giraud et al. | 340/792 |
| 4,881,150 | * | 11/1989 | Oyamada | 455/347 |
| 4,903,326 | * | 2/1990 | Zakman et al. | 455/343 X |
| 4,906,982 | | 3/1990 | Gwynn | 340/706 |
| 4,970,502 | * | 11/1990 | Kunikane et al. . | |
| 5,014,046 | * | 5/1991 | Minami | 455/351 |

FOREIGN PATENT DOCUMENTS

| | | | | |
|---|---|---|---|---|
| 2315237 | * | 1/1977 | (FR) | 63/1.1 |
| 2565724 | * | 12/1985 | (FR) | 63/20 |

OTHER PUBLICATIONS

A.F. Newell et al, "An alphanumeric display as a communication aid for the dumb," Medical and Biological Engineering, Jan. 1975, pp. 84–88.*

* cited by examiner

*Primary Examiner*—Kent Chang
(74) *Attorney, Agent, or Firm*—Weingarten, Schurgin, Gagnebin & Hayes LLP

(57) ABSTRACT

A programmable, moving display to be worn on a lapel or shirt pocket for promotional message reinforcement. The display includes a wearable display portion with a clip for attachment to a shirt pocket or coat lapel. A concealable battery portion is preferably connected to the display portion via an unobtrusive thin cable. Moving alphanumeric messages are programmed by manipulation of five buttons, allowing a user to scroll forward through an alphanumeric character table, scroll backward through that table, enter a chosen character at a display position and subsequently advance to a neighboring display position, delete characters, and modify the rate at which the characters are scrolled across the display. The messages can also be programmed externally using a personal computer connected to a data input port on the display portion.

8 Claims, 5 Drawing Sheets

WEARABLE MOVING DISPLAY

This application is a continuation of application Ser. No. 08/023,140, filed Feb. 24, 1993 entitled: A WEARABLE MOVING DISPLAY, now abandoned which is a continuation application of Ser. No. 07/939,845, filed Sep. 2, 1992, now abandonded, which is a continuation application of Ser. No. 07/636,312, filed Dec. 31, 1990 now abandoned.

FIELD OF THE INVENTION

This invention relates to alphanumeric displays and more particularly to moving message displays.

BACKGROUND OF THE INVENTION

Lapel buttons for promotional purposes that are worn by sales, clerical or other personnel are known. For example, AVIS' "We Try Harder" button is well known. There is presently no known device that can be similarly worn, is light emissive so as to attract attention from a distance, provides a moving display so that significant information is presented while the attention is naturally drawn to word motion, and can be programmed to allow short term change of the promotional message.

Moving message displays are included in vending machines, are used for displaying rapidly changing stock and bond prices, and are supported high above street level to announce events, for example. Such displays are commonly large to enhance readability, and consequently, are also quite bulky.

Wearable displays are known for amusement purposes. For example, U.S. Pat. No. 4,602,191 discloses a jacket with programmable lights in which apertures are provided over the surface of the jacket that allow tri-color light emitting diodes to protrude. The lights are programmable as to both their color and pattern of activation. The patterns of activation are abstract and cannot convey a message. Another example is disclosed in U.S. Pat. No. 4,906,982 wherein a wristwatch includes a preprogrammed stationary message display which is activated unpredictably on some, but not all of the occasions when a wearer's arm is raised to check the time.

SUMMARY OF THE INVENTION

A programmable, wearable moving display is disclosed that includes a wearable display portion with a clip to facilitate attachment of the display portion to a shirt pocket or coat lapel. A concealable battery portion is preferably connected to the display portion via an unobtrusive thin wire. Moving alphanumeric messages can be programmed by manipulating only five buttons which allow a user to scroll forward through an alphanumeric character table, scroll backward through that table, enter a chosen character at a display position and then advance to a neighboring display position, delete characters, and modify the rate at which the characters move across the display.

The programmable, wearable moving display of the invention allows a wearer to program any message up to, for example, 96 characters long. As the message scrolls through the display, a number of characters at a time can be seen in the display window, eight being the number used in the present embodiment. The message cycles, returning to the beginning after the last characters have been displayed. The rate of scrolling and cycling is controllable by the wearer. The device includes a memory that retains the message that was most recently programmed, even when the display is off.

Preferably, to facilitate attachment of the display to a variety of points on a wearer's garments, the clip can be detached from the display portion, rotated by 90° or 180°, and be reattached to the display portion to provide a choice of four orthogonal clip orientations. Alternatively, nylon hook and loop fabric, such as VELCRO® can be used for attaching the display to a wearer's garment.

DESCRIPTION OF THE DRAWING

The invention will be more fully understood from the following detailed description, in conjunction with the accompanying figures, in which.

DETAILED DESCRIPTION OF THE INVENTION

The wearable moving display of the invention, in a preferred embodiment, is a programmable alphanumeric display adapted for attachment to a jacket lapel or shirt pocket. It is a self-contained battery-powered promotional reinforcement item which allows the user to program any message up to 96 characters long, scrolling 8 characters at a time across the display.

Figure 1:
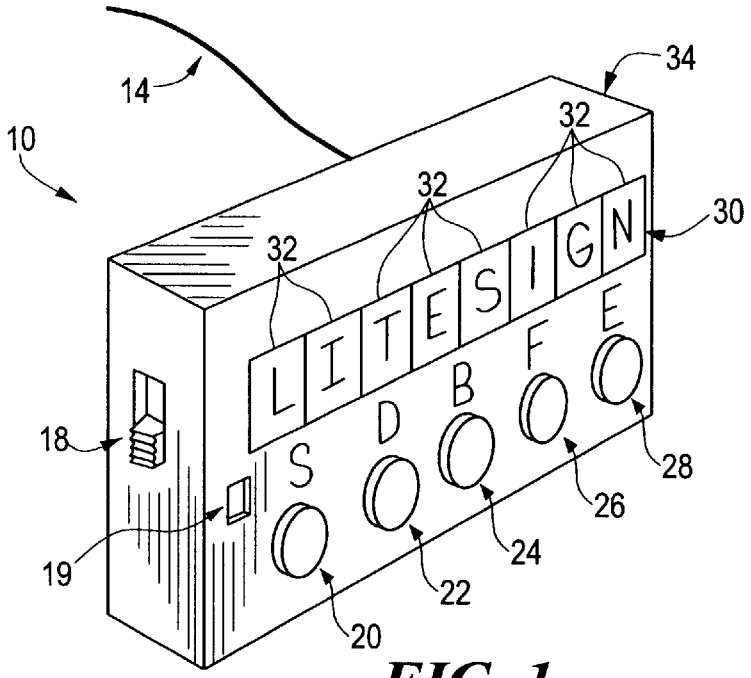
FIG. 1 is an oblique view of a display portion of the invention.
Figure 2:
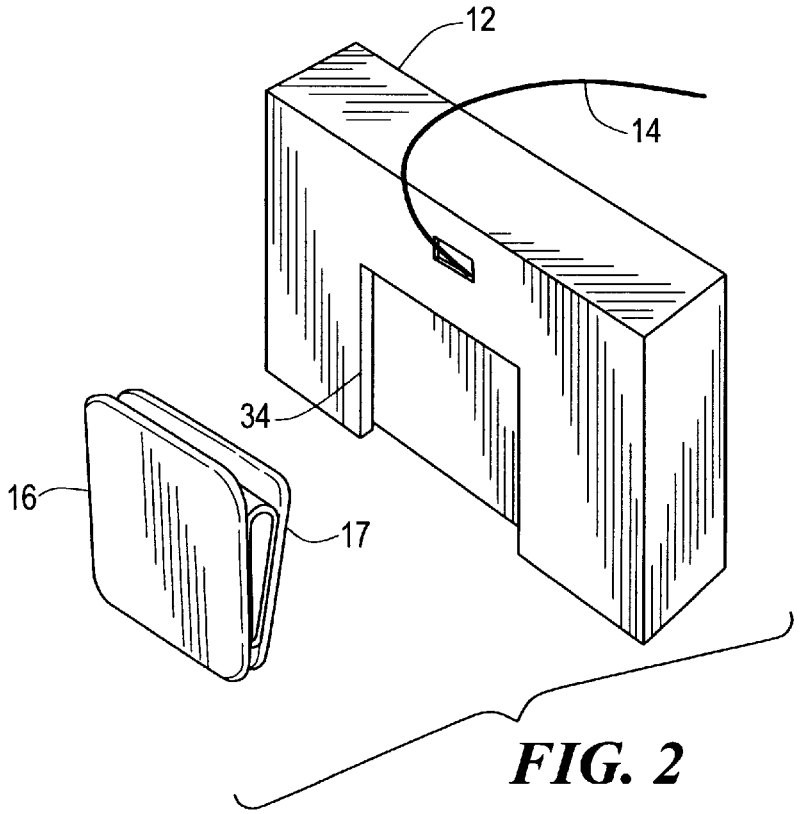
FIG. 2 is an oblique view of a battery portion of the invention, along with its clip.

In the preferred embodiment, shown in FIGS. 1 and 2, a display portion 10 is connected to a battery portion 12 via a battery cable 14. An attachment clip 16 is insertable into a recess 34 on the rear of the display portion 10.

With reference to FIG. 1, the display portion 10 has an on/off switch 18 for controlling power to the overall unit. When the unit is turned on, it will flash an introductory message on its display window 30, such as "LITESIGN" (a Trademark of the Applicant), and then it displays the previously programmed message, or "Enter your message" if none has been previously programmed.

The display portion 10 has five buttons 20, 22, 24, 26, and 28 that control programming, and scroll rate, i.e., the rate at which characters are scrolled or moved across the display window 30. The display window 30 includes eight alphanumeric character display units 32, which may be light emitting diodes (LEDs) or liquid crystal display units (LCDs).

Figure 3:
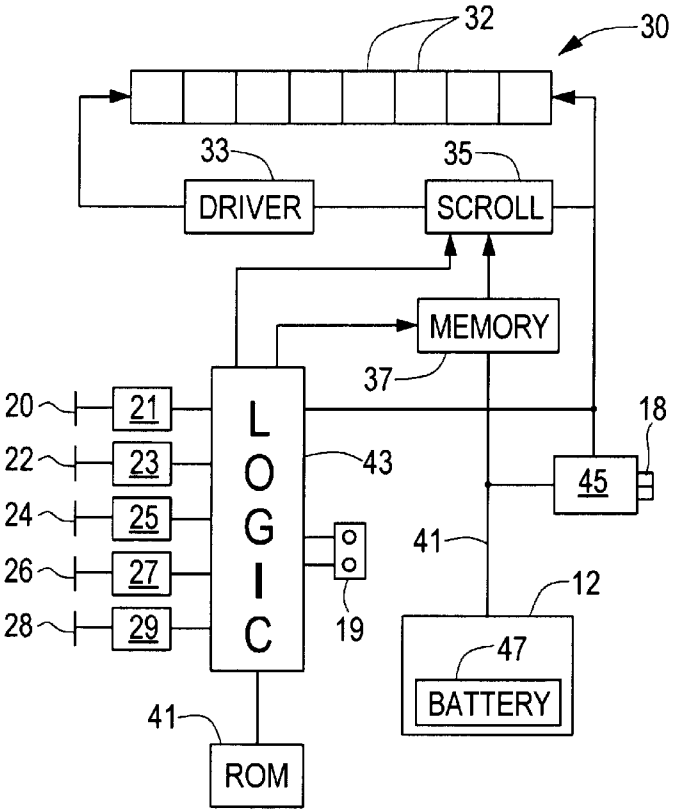
FIG. 3 is a block diagram of the electronics of the display portion.

Referring to FIG. 3, the display window 30 with the display unit 32 is driven by a display unit driver 33 from scroll circuitry 35 for moving a message consisting of a plurality of characters across the display window 30. The display unit driver 33 is responsive to a memory unit 37 that provides character information to the display unit driver 33. An input unit 39 includes a ROM that maintains a table 41 of alphanumeric characters from which a message can be assembled using the buttons 22, 24, 26, and 28 via switches 23, 25, 27, and 29 through logic 43. The table can include characters required for forming words in English, Spanish, French, German, or Italian, as well as the entire ASCII character set, for example. Logic 43 interrupts simultaneous activation of the scroll rate button 20 with any of the other four buttons as a memory 37 clear. This action will clear the screen 30 of prior messages and load into memory 32 from ROM 41, a user prompt consisting of, for example, "LITE-SIGN Enter your message." The memory unit 37 maintains its contents even after the unit has been turned off using the on/off switch 18. This is accomplished by switch 18 that disconnects power from a battery unit 47 to all parts except memory 37.

Figure 7:
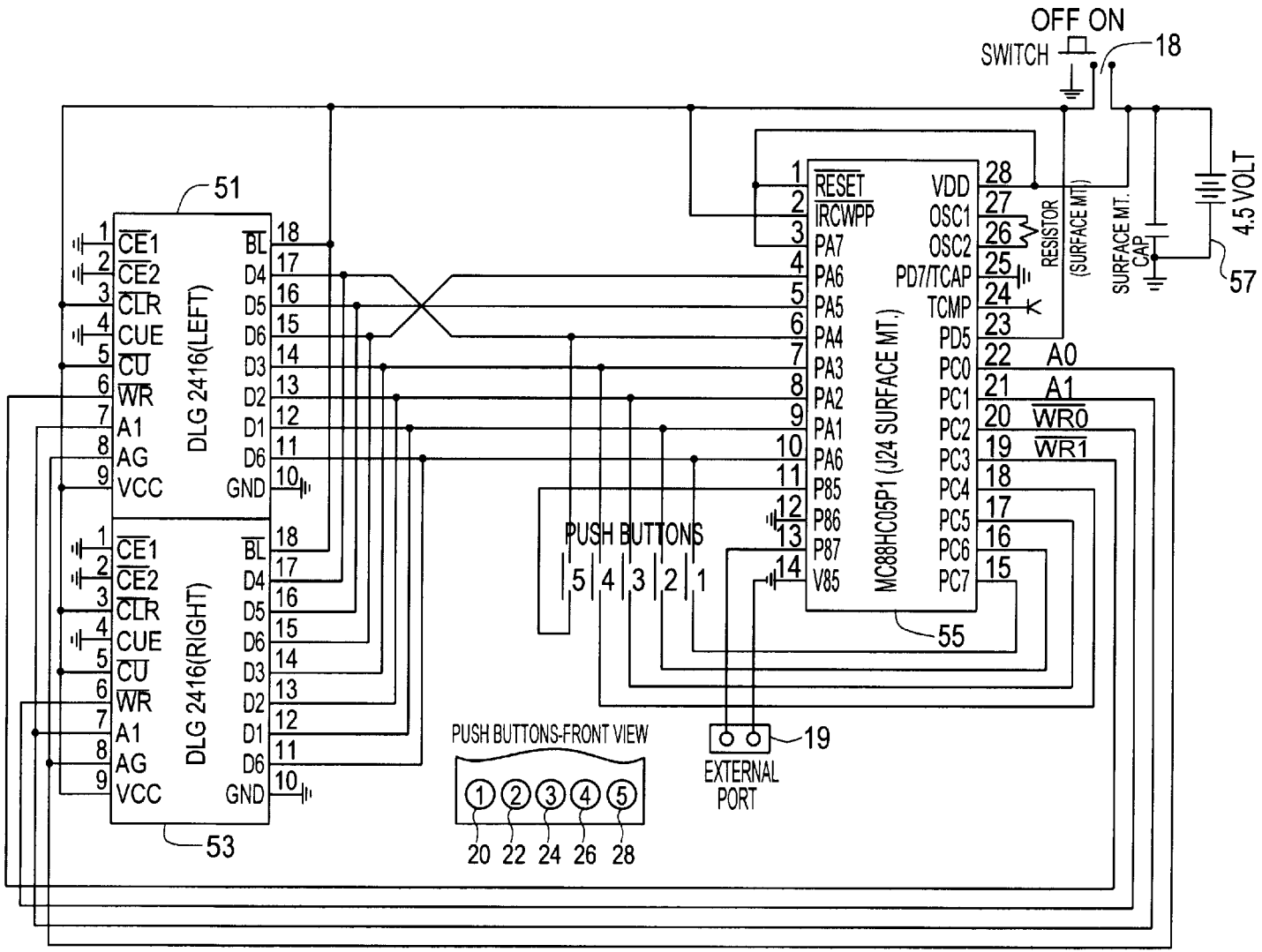
FIG. 7 is a schematic diagram of the logic unit and push buttons of FIG. 3.

With reference to FIG. 7, a preferred embodiment of the logic of FIG. 3 is shown, wherein two programmable logic arrays 51 and 53 are connected to a microprocessor 55, and are each programmed to perform the logic and processing functions of the elements shown in FIG. 3. The external port 19 is provided to allow messages to be downloaded into the microprocessor 55 from a personal computer (PC). Alternatively, the buttons 20, 22, 24, 26, 28 allow a user to enter a message without using a PC in conjunction with the port 19. The switch 18 controls power to the units 51 and 53, which in the preferred embodiment is a 4.5 volt power source 57.

Figure 6A:
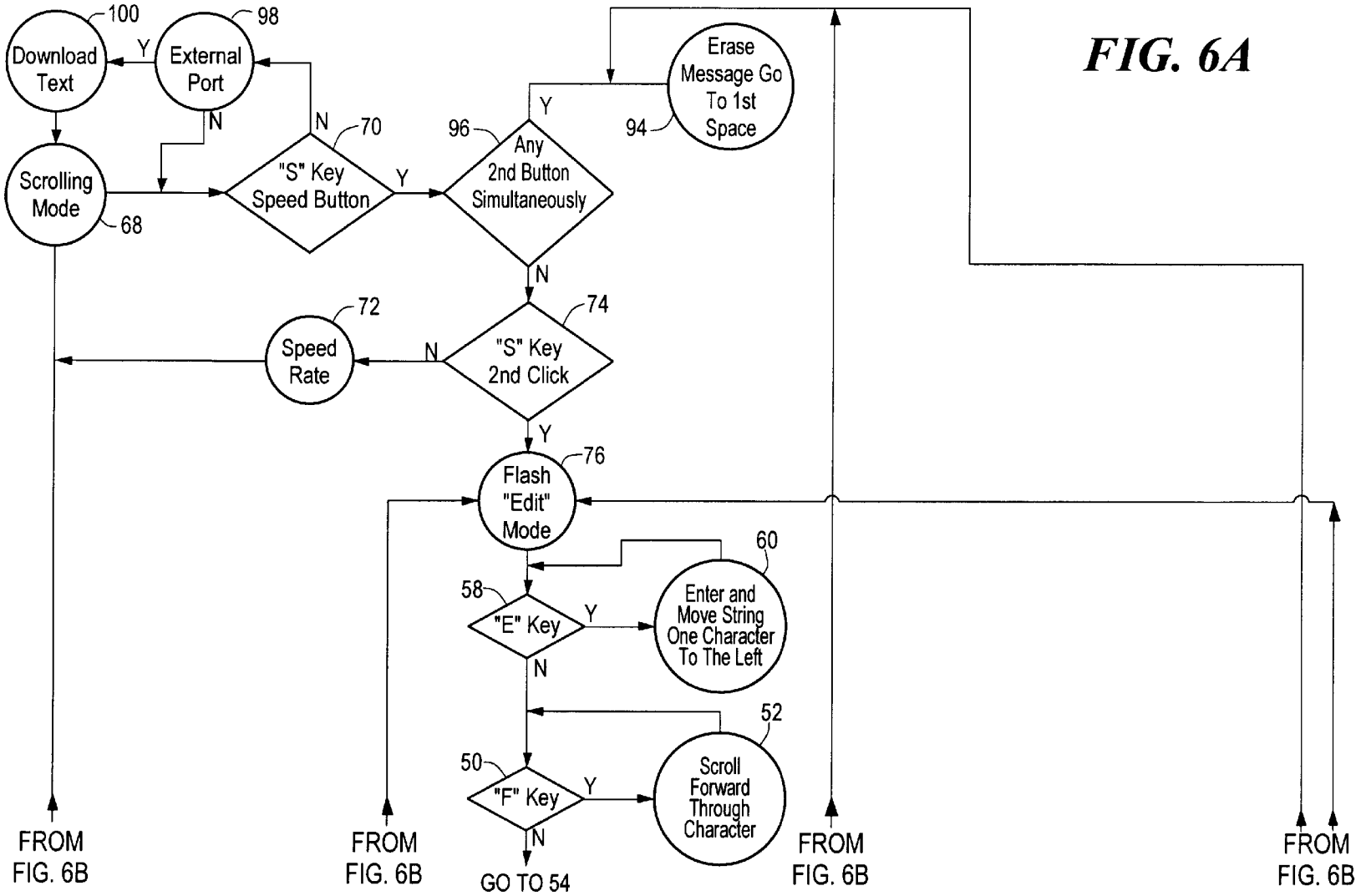
FIG. 6 is a flow chart illustrating scrolling and programming using the five buttons shown in FIG. 1.
Figure 6B:
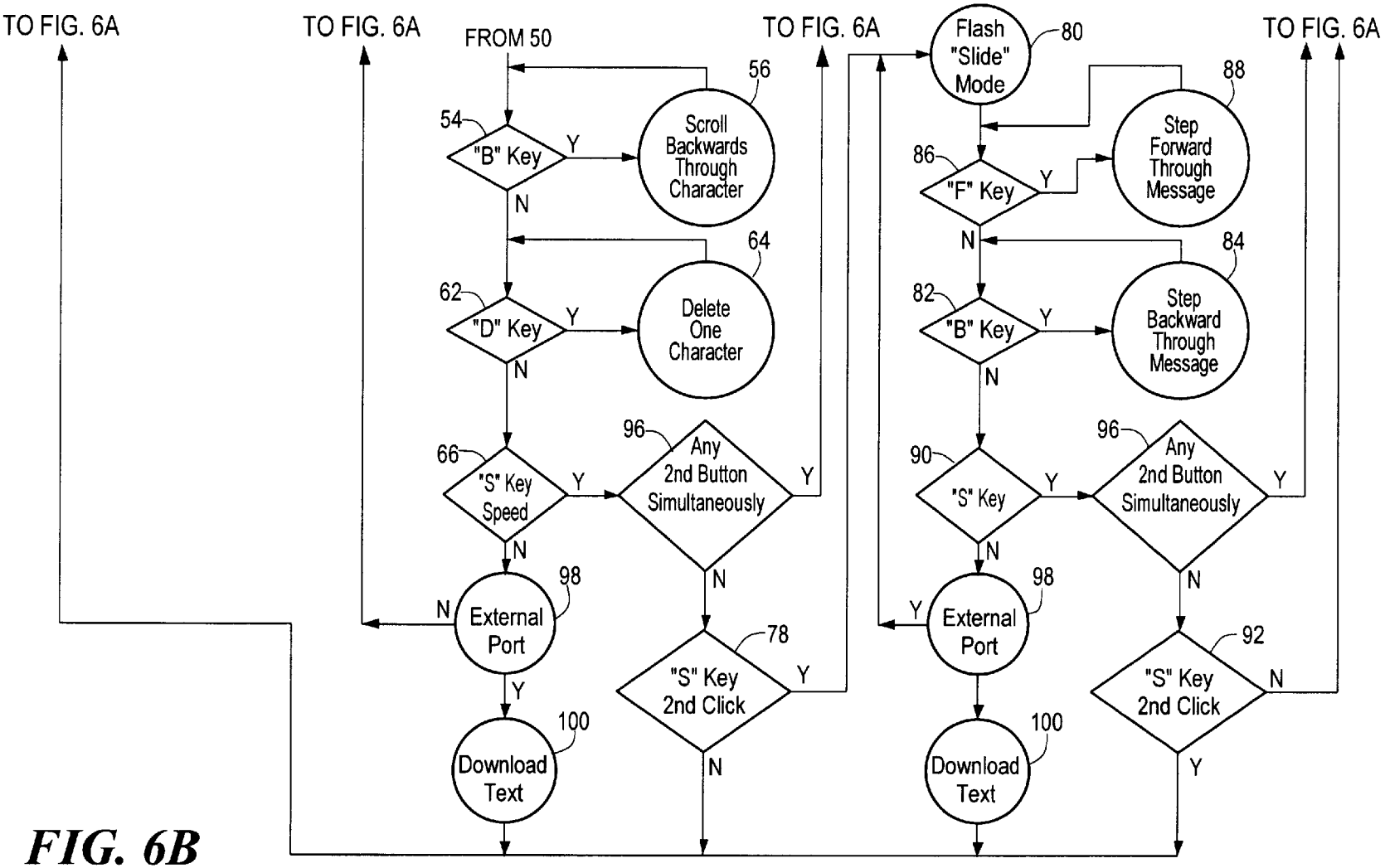

Referring to FIGS. 3 and 6, where reference numbers from the flow chart of FIG. 6 are indicated by parentheses, logic 43 responds to activation (50) of button 26 to load from memory 41 into memory 37, and thus scroll (52) through the display 30 a table of possible alphanumeric characters stored, including for example, all the letters of the alphabet, the digits 0–9, and commonly used punctuation, until the desired character is displayed. A single activation (50) of the button 26 causes letters to appear in the far right module of the display, one at a time. As long as the button 26 is pressed, the unit will automatically cycle through the table of letters, numbers, and symbols in the ROM 41. Button 26 is released when the desired symbol appears. If the desired symbol passes out of the display unit 32, it may be recalled by pressing (54) the BACKWARDS button 24 to scroll (56) the characters backwards through the table of symbols until the desired symbol reappears.

Upon reaching the desired symbol, activation (58) of the ENTER button 24 will load (60) the selected letter in the memory 37 in a location where it is caused to be displayed in the second display unit 32 of the display 30. All of the characters are shifted left (60). Repeated operation of buttons 24, 26 and 28 allows entry of an entire message. Pressing (62) the DELETE button 22 via switch 23, causes the symbols to back up, erasing the message character-by-character (64).

It is advisable to insert at the end of a message a few "spaces" to insure that the last word and first word don't run into each other. Activation (66) of the SCROLL RATE button 20 via switch 21 causes the message to start scrolling (68).

In the preferred embodiment, the scroll unit 36 is capable of three scroll rates. By activation (70) of the SCROLL RATE button 20, the rate of scrolling can be increased (72). To accomplish this, a signal is sent from logic 43 to unit 35.

To edit the existing message from the end of the message, a sequence of two pushes (70, 74) of the SCROLL RATE button 20 is interpreted by logic 43 to cause memory 37 and scroll 35 to flash (76) "Edit" on the screen and scroll to the end of the stored message. Each activation (54) of the BACKWARDS button 24 causes memory displayed by scroll 35 to step backwards (56) through the message, sequentially erasing letters at the leftmost position. The buttons 20–28 are activated to enter new characters at any point as described above.

It is also possible to scroll backwards without erasure. The SCROLL RATE button 20 is pushed twice (70, 74). The screen will flash (76) "Edit" and go to the end of the message. The SCROLL RATE button 20 is again pushed twice (66, 78). The memory 37 and scroll 35 will send to the screen a flashing "Slide" message (80). Pressing (82) the BACKWARDS button 26 allows stepping backwards (84) through the message, and pressing (86) the FORWARDS button 28 allows stepping forward (88) through the message. Pressing (90) the SCROLL RATE button 20 twice again (90, 92) causes the previous described flashing of "Edit". Editing then proceeds from this point as described above.

To erase any message completely (94) and return to the rightmost position of the display 30 at any time during the above procedure, the SCROLL RATE button 20 is pressed simultaneously (96) with any of the other buttons 22, 24, 26, 28.

The display portion 10 can also be programmed without using any of the buttons 20, 22, 24, 26, 28 by using a personal computer (PC) connected (98) to the display portion 10 via an external port 19. Once the text is downloaded (100) into the memory 37, the display portion 10 enters the scrolling mode (68).

Figure 5:
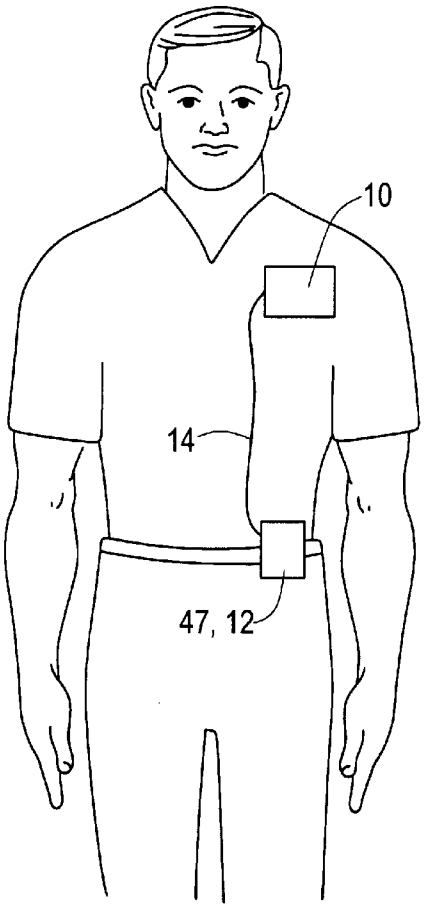
FIG. 5 is a view of the invention in use on a person.
Figure 4:
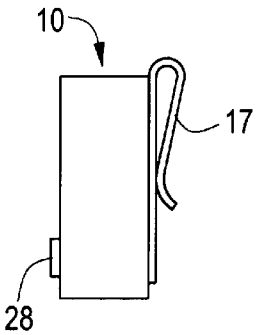
FIG. 4 is a side view of the display portion with an alternate embodiment of an attachment clip.

With reference to FIG. 2, an attachment clip 16 has a square back panel 17 that is adapted to slide into and be retained in a recess 34 in the back of the battery portion 12, as well as the back of the display portion 10 (not shown). The walls of the recess 34 are beveled inward to create a track within which matching bevels of the panel 17 of the clip 16 can slide. The clip 16 can be removed, the panel 17 rotated by 90 or 180 degrees in either direction, and can be placed back into the recess 34 to allow placement of the unit in a desired orientation on a coat lapel, shirt pocket, hat or any other convenient place that is amenable for both showing and supporting the invention, as shown in FIG. 5. For example, with the clip 16 oriented such that its opening faces downward, the unit neatly slips over the top of a coat pocket. Alternatively, by rotating the clip 16 by 90 degrees, the display portion 10 can be attached to a coat lapel. The battery portion 12 can be placed in an inside coat or shirt pocket. Power is conducted over a preferably thin, unobtrusive cable connecting the display portion 10 and the battery portion 12. In an alternate embodiment, a clip 16 can be affixed to the back of the display portion 10 by way of any releasable adhesive, such as VELCRO®.

It is also contemplated that the display of the invention can be placed on a shelf next to small items for advertising purposes. In this embodiment, an adaptor can be used to provide electrical power from a standard 110 V AC outlet, or if no outlet is accessible, the batter portion 12 can be used.

Other modifications and implementations will occur to those skilled in the art without departing from the spirit and the scope of the invention as claimed. Accordingly, the above description is not intended to limit the invention except as indicated in the following claims.

What is claimed is:

1. An electronic lapel button for public displaying of a scrolling digital message comprising a plurality of characters comprising:

a lapel-pin-size housing;

an alphanumeric display on an outwardly facing surface of said housing;

an attachment on an opposite, non-adjacent surface of said housing;

a digital message memory located within said housing for recording the digital message;

a driver for driving said display in continuous scrolling fashion with the digital message so that said digital message cycles, returning to a first character after a last character has been displayed resulting in continuous re-display;

a digital message store circuit within said housing and adapted to operate in response to manually activated controls to generate and store the digital message in said message memory;

manually activated controls associated with said housing for selecting said characters of said digital message on a one-by-one basis for storage in said message memory by said message store circuit;

a battery for powering said alphanumeric display, message memory, and message store circuit; and a cable attaching said battery to said housing for powering said message memory, said message store circuit, said driver, and said display.

2. A method for public displaying of a scrolling digital message comprising a plurality of characters from an electronic lapel button comprising the steps of:

providing a lapel-pin-size housing having a display on a first outwardly facing surface;

attaching the housing to an upper portion of a wearer's body using an attachment on a surface opposite said first surface;

selecting said plurality of characters comprising said digital message on a one-by-one basis using manually activated controls associated with said housing;

storing the digital message using a digital message store circuit within said housing that is adapted to operate in response to the manually activated controls;

driving said display in continuous scrolling fashion with the digital message so that said digital message cycles, returning to a first character after a last character has been displayed resulting in continuous re-display;

powering said alphanumeric display, message memory, and message store circuit with a battery; and connecting said battery to said housing using a cable so that said battery is concealable from said third parties.

3. The electronic lapel button recited in claim 1 wherein said driver includes means for driving said display in continuous scrolling fashion at one of a selected plurality of scroll rates.

4. The electronic lapel button recited in claim 1 wherein said digital message store circuit comprises a table of stored alphanumeric characters and wherein said stored alphanumeric characters are sequentially displayed at a predetermined location of said display and desired ones of said alphanumeric characters selected for inclusion in said digital message in response to activation of said controls.

5. The method recited in claim 2 wherein said step of driving said display comprises the step of selecting one of a plurality of scroll rates.

6. The method recited in claim 2 further comprising the step of storing a table of alphanumeric characters, sequentially displaying said stored alphanumeric characters at a predetermined location of said display, and selecting desired ones of said alphanumeric characters for inclusion in said digital message in response to activation of said controls.

7. An electronic lapel button for public displaying of a generated digital message comprising:

a lapel-pin-size housing;

an alphanumeric display disposed on an outwardly facing surface of said housing;

an attachment disposed on an opposite, non-adjacent surface of said housing;

a driver for driving said display with said message in continuous scrolling fashion;

a first memory disposed within said housing for storing a table of alphanumeric characters;

a second memory for storing said generated digital message; and operator actuatable controls disposed on said housing for generating said digital message for storage in said second memory, wherein said stored alphanumeric characters are displayed at a predetermined location of said display and desired alphanumeric characters selected for inclusion in said digital message in response to said operator actuatable controls.

8. The electronic lapel button recited in claim 7 wherein the rate of scrolling said digital message is adjustable in response to said operator actuatable controls.

* * * * *